United States Patent [19]

Horn

[11] Patent Number: 4,807,407

[45] Date of Patent: Feb. 28, 1989

[54] MODULAR BUILDING SYSTEM FOR A THREE-STORY STRUCTURE

[75] Inventor: John J. Horn, El Toro, Calif.

[73] Assignee: PBS Building Systems, Anaheim, Calif.

[21] Appl. No.: 64,545

[22] Filed: Jun. 22, 1987

[51] Int. Cl.[4] ..... E04H 1/00

[52] U.S. Cl. ..... 52/79.1; 52/125.2; 52/125.6

[58] Field of Search ..... 52/125.2, 125.6, 79.1, 52/79.3, 79.9, 79.2, 79.7, 79.8

[56] References Cited

U.S. PATENT DOCUMENTS

| | | | |
|---|---|---|---|
| 3,103,709 | 9/1963 | Bolt | 52/125.2 |
| 3,913,286 | 10/1975 | Boutacoff | 52/79.1 |
| 3,940,890 | 3/1976 | Postlethwaite | 52/79.3 |
| 3,990,197 | 11/1976 | Johnston | 52/79.1 |
| 4,106,243 | 4/1978 | Horn | 52/79.1 |
| 4,545,158 | 10/1985 | Rizk | 52/79.1 |
| 4,545,159 | 10/1985 | Rizk | 52/79.9 |

FOREIGN PATENT DOCUMENTS

| | | | |
|---|---|---|---|
| 1077602 | 2/1900 | Fed. Rep. of Germany | 52/79.1 |

*Primary Examiner*—Henry E. Raduazo

*Attorney, Agent, or Firm*—George F. Bethel; Patience K. Bethel

[57] ABSTRACT

A multi-story modular structure is constructed of a horizontal and vertical array of modular units. Each unit forms an enclosure of a space and is comprised of a perimeter frame, side walls rising from the perimeter frame and a ceiling truss connected to the side walls to complete the modular unit. The modular unit has integrated into the side wall four lifting points. Each lifting point includes the reinforcement within the truss structure and in the perimeter frame for receiving a lifting rod. Lifting rods, which form part of the lifting harness and not part of the modular unit are then placed into the modular unit and the unit can be horizontally or vertically moved by a construction crane through the use of a universal or reusable overhead harness. Lateral stiffening of the multi-story structure constructed from such modular units is accomplished by means of integral diagonal straps designed into the exterior sidewalls of the outer modular units between each of the window frames within the outer side walls. The number of stiffening straps decreases as the position of the modular side wall ascends in the multi-story structure.

18 Claims, 4 Drawing Sheets

MODULAR BUILDING SYSTEM FOR A THREE-STORY STRUCTURE

BACKGROUND OF THE INVENTION

1. Field of the Invention

The invention is in the field of the architectural and building arts. In particular, the invention is directed to the design and construction of a large three story structure from modular units which are transported to the construction site and partially constructed in modular form and then assembled to complete a multi-story structure.

2. Description of the Prior Art

Modular building structures have long been employed wherein construction units small enough to easily transport are assembled at the construction site to collectively comprise a larger structure. The lack of success of many prior art designs arises to an inherent diffculty in all modular designs, namely the smaller the modular unit the easier is the transportation, but the more extensive is the on-site assembly. Alternatively, the larger the modular unit, the less the on-site assembly, but the greater expense and difficulty of transportation from the manufacturing site to the construction site.

These inherent difficulties become even greater as the size of the structure grows. It is even more difficult to provide a design which allows for minimal construction site assembly when a multiple storied commercial structure is to be fabricated. In such a case, not only must the modular assembled units encompass not only a large planar space, but must be combinable in such a manner that the large planar space can be multiplied in the vertical axis to accommodate multiple stories.

Therefore, what is needed is a modular design which adapts itself to simple onsite assembly of a large multistory commercial structure without losing or compromising the ease of transportability of modular units which comprise it or entailing complicated on-site fabrication techniques.

BRIEF SUMMARY OF THE INVENTION

The invention is an improvement in prefabricated multi-story structures assembled with the use of a single reusable harness. The improvement comprises a plurality of metallic modular units. Each unit comprises in turn a perimeter frame with a plurality of sides, a corresponding plurality of side walls rigidly connected to each the side of the perimeter frame, and a ceiling truss connected to the side walls. The plurality of modular units are adapted for arrangement into an array to comprise the multi-story structure. A structural arrangement provides an attachment for lifting the module and is arranged and configured to attach to the harness.

As a result, the plurality of modular units may each be lifted and assembled in a horizontal and vertical stacked array to form the multi-story structure.

The structural arrangement for providing a lifting attachment to each modular unit comprises a plurality of lifting arrangement integrated into the modular units. Each lifting arrangement comprises a lifting rod, and a structural arrangement for securing the lifting rod to the ceiling truss. The lifting rod is disposed through the side walls. The improvement includes a structural arrangement for connecting the lifting rod to the perimeter frame.

The ceiling truss comprises an upper rafter and a lower rafter. The structural arrangement for securing the lifting rod to the ceiling truss comprises a bore defined through the upper rafter and a bore aligned therewith defined through the lower rafter. The upper and lower rafters reinforcing plates fixed thereto in the position of the bores. A reinforcing element connects the upper and lower rafters together within the ceiling truss.

The reinforcing element for connecting the upper and lower rafters within the truss comprises diagonal bracing connected at opposing ends to the upper and lower rafters.

The structural arrangement for connecting the upper and lower rafters further comprises a vertical truss connected at one end to the upper rafter and connected at the other end to the lower rafter.

The vertical truss is comprised of four spaced-apart vertical elements generally parallel to the lifting rod and connected at its ends to the upper and lower rafters proximate to the bore defined through the rafters for the lifting rod.

The structural arrangement for connecting the lifting rod to the perimeter frame comprises a temporarily fixable connection to the perimeter frame and a structural arrangement for stiffening the perimeter frame in the proximity of the temporarily fixable connection.

The temporarily fixable connection is a threaded bolt connection defined on the lower end of the lifting rod and a bore defined through the perimeter frame. The lifting rod is disposed through the bore and temporarily fixed through the perimeter frame by attachment of a bolt onto the threaded end of the lifting rod. The structural arrangement for stiffening the perimeter frame comprises a vertical stiffening plate affixed to the perimeter frame in the proximity of the bore.

The array of modular units includes a vertical disposition, and further comprises a structural arrangement for stiffening the side walls of each of the plurality of modular units. The degree of stiffening incorporated within the side wall of each modular unit is reduced as the vertical position of the modular unit within the array moves upwardly.

The invention and its various embodiments are better visualized by considering the following drawings wherein like elements are referenced by like numerals.

The invention and its various embodiments may now be better understood by turning to the following detailed description.

DETAILED DESCRIPTION OF THE PREFERRED EMBODIMENTS

A multi-story modular structure is constructed of a horizontal and vertical array of modular units. Each unit forms an enclosure of a space and is comprised of a perimeter frame, side walls rising from the perimeter frame and a ceiling truss connected to the side walls to complete the modular unit. The modular unit has integrated into the side wall four lifting points. Each lifting point includes the reinforcement within the truss structure and in the perimeter frame for receiving a lifting rod. Lifting rods, which form part of the lifting harness and not part of the modular unit are then placed into the modular unit and the unit can be horizontally or vertically moved by a construction crane through the use of a universal or reusable overhead harness. Lateral stiffening of the multi-story structure constructed from such modular units is accomplished by means of integral diagonal straps designed into the exterior sidewalls of the outer modular units between each of the window frames within the outer side walls. The number of stiffening straps decreases as the position of the modular side wall ascends in the multi-story structure.

Figure 1:
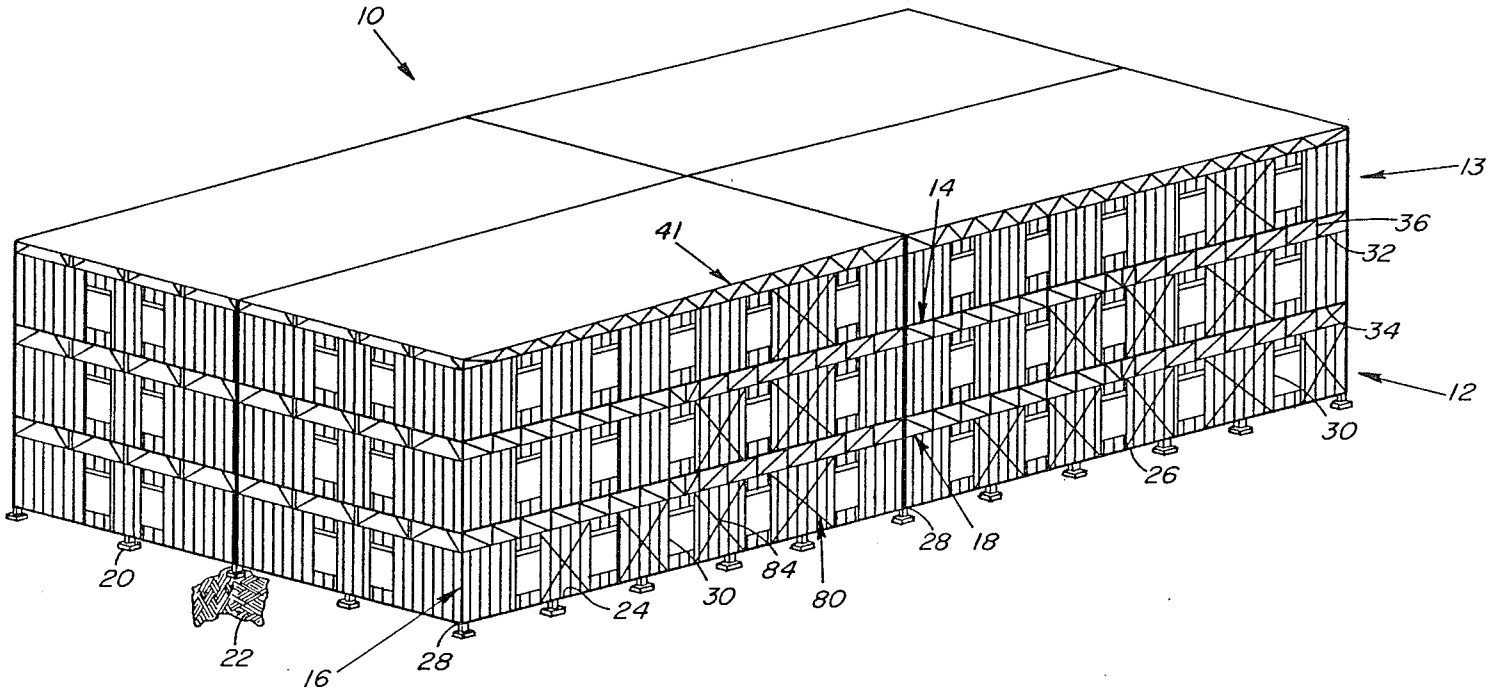
FIG. 1 is a perspective view of a plurality of modular units combined to comprise a multi-storied structure according to the invention.

FIG. 1 is a simplied perspective view of a three story structure made from modules according to the invention. The structure, generally denoted by reference numeral 10 is comprised in the illustrated embodiment of modules approximately 60 feet in width and 120 feet in length. The first and second floors are each comprised of at least four such modules, each module which is generally rectangular. The third floor is also comprised of four such modules, but is provided with a gently slanted roof. Otherwise, each of the modules of the third floor are also generally rectangular.

Each module, generally denoted by a reference numeral 12, is individually transported to the assembly site. Each module 12 includes a multiple axle (not shown) which is later removed. Thus, the module itself is prefabricated to form an integral unit which serves as its own trailer and is transported to the assembly site, stacked in the array, as depicted in FIG. 1. Each module which is comprised of a steel framed unit is welded to the adjacent modules in the assembled structure 10.

FIG. 1 depicts the outer steel framing. All out covering and internal framing has been removed for the sake of clarity. As depicted in FIG. 1, each module 12 is characterized by a double floor 14, vertical columns 16 comprising the side and end walls, and a ceiling truss generally denoted by reference numeral 18. Modules 12 which comprise the first floor are disposed upon a conventional foundational base, such as concrete piers 20 embedded within earth 22. Flooring 14 is described in greater detail in the co-pending application entitled "Integral Module System," filed Feb. 25, 1987, Ser. No. 018,916 which is hereby expressly incorporated by reference. Therefore, the details of floor and roof elements discussed in that application will only be mentioned here to the extent necessary to provide a background.

Thus flooring 14 is typically comprised of plywood flooring underlayment supported on 1½ 22" gage corrugated metallic decking which is collectively denoted by reference numeral 24. The plywood floor underlayment and metallic decking 24 in turn are supported by 6" by 2½ 14 gage metallic floor joists on 24' centers welded across a rectangular perimeter frame 28. The base of each module 12 is comprised of perimeter frame 28 which is supported by concrete fittings 20 and attached through welded steel trusses to anchor bolts with fittings 20.

Similarly, at each of the four corners of module 12 is a 3½ steel column 16. The exterior side walls of module 12 are comprised of a plurality of 9 foot long, 26 gage steel studs placed on 16" centers. At approximately each 10 feet is a window 30 is defined in the exterior wall. Above the 9 foot exterior walls is an approximate 3'8" ceiling truss structure 18. The truss structure in the first two floors is a rectangular truss assembly comprised of a steel beam fabricated from two right angle beams welded back to back to form a bottom cord 32 connected to 5×3×178 inch angle iron beams which are welded back to back to form the top cord 24 of truss 18.

Figure 2:
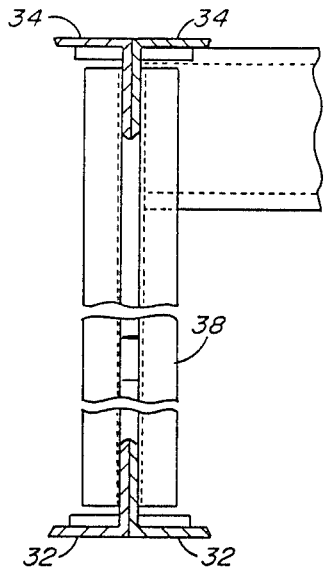
FIG. 2 is a sideview of the vertical truss in the roof trusses as depicted in FIG. 1 shown in enlarged scale and in greater detail.

The bottom cord 32 and top cord 34 are coupled by means of a plurality of vertical trusses 38 which again in turn are comprised of two 1×1×174 inch angle irons to top cord 34 and bottom cord 32. The detail of the vertical truss is seen in FIG. 2. A plurality of diagonal trusses 36 also join top cord 24 with bottom cord 32. Diagonal trusses 36 are similarly comprised of two 1×1×1 inch angle irons welded on each side of the beveled flange of the top cord 34 and the bottom cord 32.

The top floor modules 12 are substantially identical to the first and second floor modules with the exception that, as shown in FIG. 1, the ceiling truss of the top floor module 12 does not include any vertical trusses but is comprised of diagonal trusses which form a gentle slope for the roofing to be placed upon upper story truss 41. In the illustrated embodiment, the slope provided by roof truss 39 is approximately 12"for 60 feet of run.

The basic framework of each module 12 now having been described, consider the means by which modules 12 are hoisted to comprise a multi-storied structure of FIG. 1, and secondly, the means by which modules 12 are reinforc integrity against heavy wind forces or other lateral loads.

Figure 3:
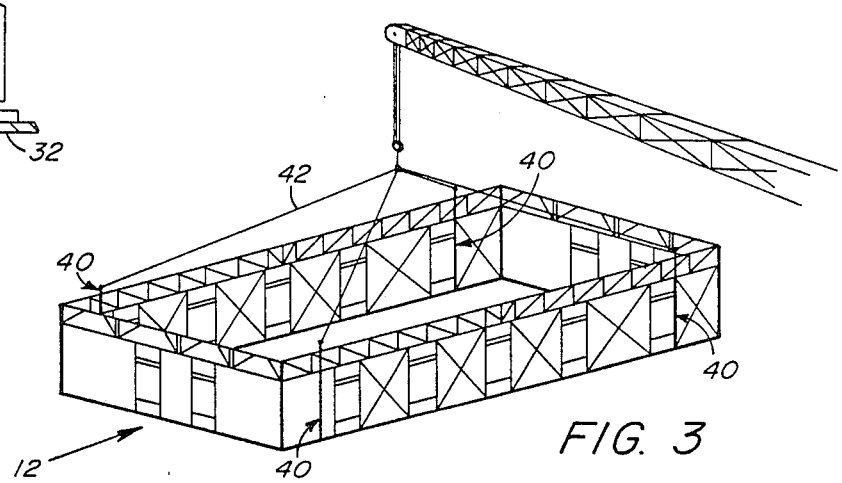
FIG. 3 is a perspective view of one of the 60×120 foot modules being lifted through structural attachments according to the invention.
Figure 4:
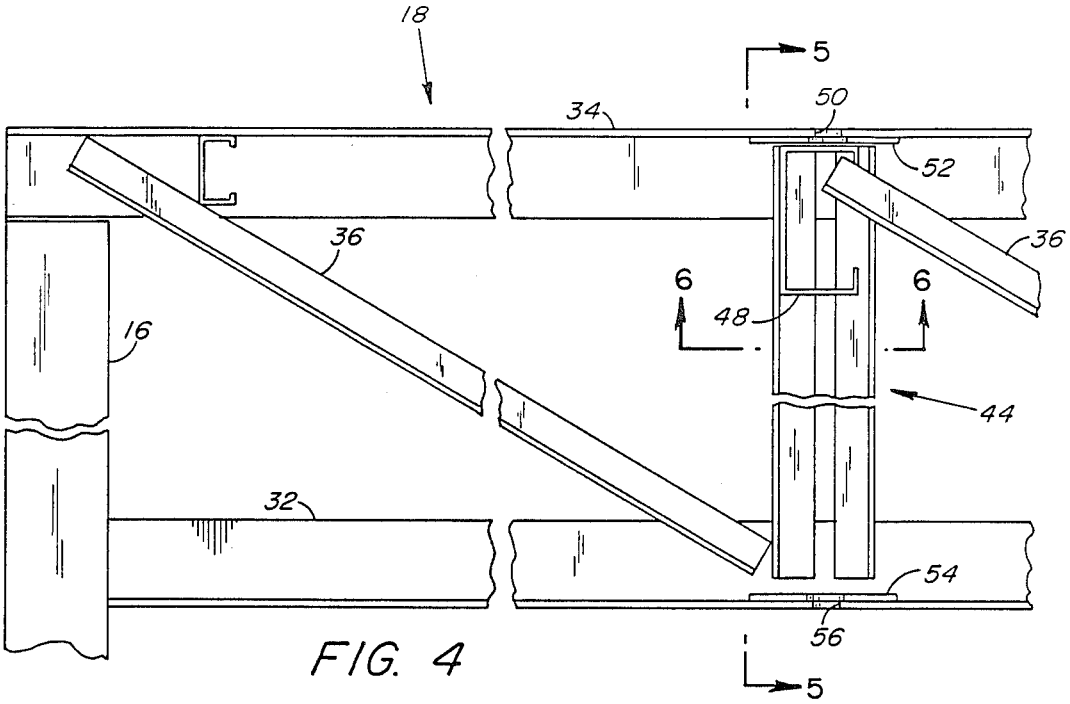
FIG. 4 is a side view of a portion of the roof truss of a lower story module shown in enlarged scale and greater detail wherein part of the lifting element of the invention is depicted.
Figure 5:
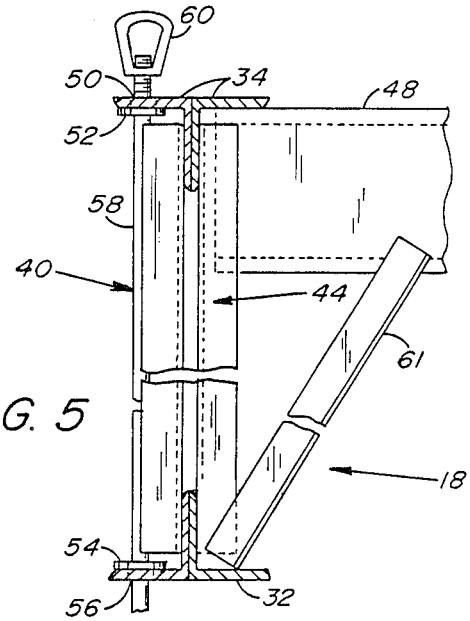
FIG. 5 is a sideview of the portion of the lifting element shown in FIG. 4 as seen in an orthogonal direction to the view of FIG. 4.
Figure 6:
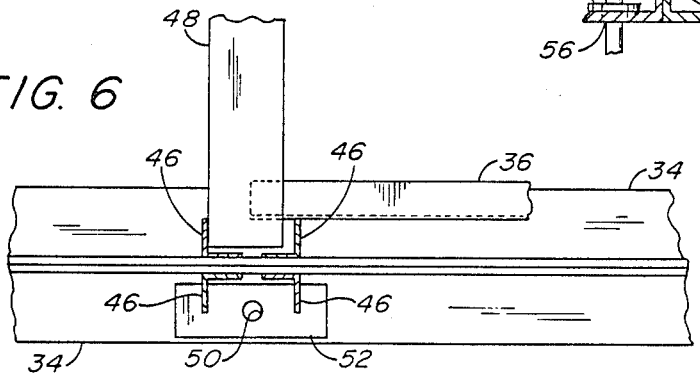
FIG. 6 is a top plan view of the portion of the lifting element shown in FIGS. 4 and 5.

FIG. 3 is a perspective view of one of the 60×120 oot modules 12 being lifted through structural attachments according to the invention. Placed within each side wall of module 12 is a lifting element, generally denoted by reference numeral 40, to which a conventional cable harness 42 is attached and lifted by means of a construction crane (not shown) Elements 40, as will be seen in the subsequent Figures, is built into module 12 and is arranged and configured for convenient and temporary mechanical coupling to harness 42. Turn and consider firstly the lifting element 40 as would be incorporated in lower story modules 12 as in contradistinction to upper story modules 13 as depicted in FIG. 1. Turn to FIG. 4 where an upper portion of module 12, to wit truss 18 is depicted. One of the vertical elements, replacing element 36 within truss 18 is a doubled vertical riser 44 which is depicted in the side views of FIGS. 4 and 5 and in the top plan view of FIG. 6. Vertical riser 44 is comprised of four angle irons 46 welded between the back to back rafters 32 and 34. The four angle irons are best depicted in the plan view of FIG. 6 which shows their attachment to the upper rafter 34. The angle irons forming the vertical truss at the lifting point are welded to rafter 34 at one end and to rafter 32 at the other end to form a symmetrical square array as depicted in the plan view of FIG. 6. A purlin 48 is welded to rafter 34 and one of the vertical trusses 46 to form the horizontal elements within truss 18 across module 12. FIG. 6 also shows the diagonal bracing provided between purlin 48 and vertical truss member 44 by means of diagonal brace 61. A hole 50 is drilled through the opposing rafter 34 as best depicted in FIG. 5. A reinforcing plate 52 is welded to the horizontally extending flange of rafter 34 in the position of hole 50. Hole 50 is therefore defined through rafter 34 and the underlying reinforcing plate 52. A similar reinforcing plate 54 is also welded to the horizontal extending flange of lower rafter 32 at a position vertically beneath and aligned with hole 15 in rafter 34. A corresponding aligned hole 56 is thus drilled through lower reinforcing 54 plate in loweer rafter 32.

A lifting rod can then be inserted at the site, as shown in greater detail in FIG. 5, through holes 15 and 56 and fastened to a receiving element in the floor below as will be described in greater detail in connection with FIG. 7. The lifting rod has been omitted from the views of FIGS. 4 and 6 for the purposes of clarity, but has been included in the side elevational view of FIG. 5. Thus, it can readily be seen that lifting rod 58, having a swivel hook attachment 60 at its upper end, is inserted through hole 50 in reinforcing plate 52 and into the corresponding opposing hole 56 in lower rafter 32 and reinforcing plate 54.

Figure 7:
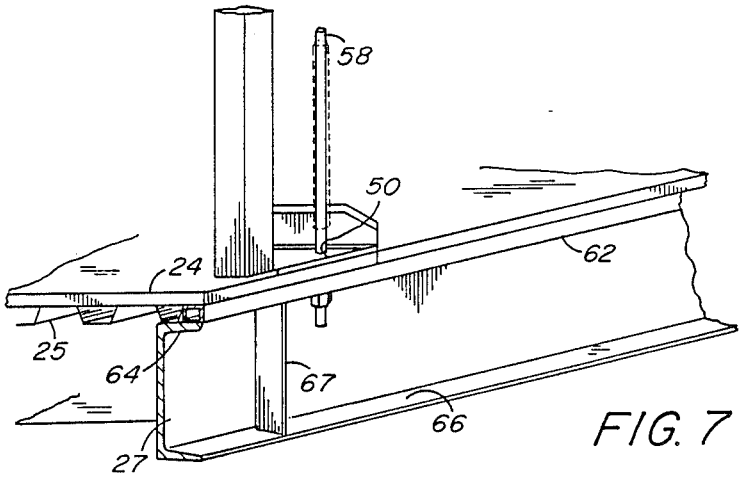
FIG. 7 is a broken sideview of a portion of a floor truss associated with lifting point illustrated in FIGS. 4–6.

Turn now to FIG. 7 wherein lifting rod 58, which may be a $\frac{7}{8}''$ diameter steel rod, is shown as disposed through a 1" hole 60 defined through plywood flooring 24 and its underlying corrugated pan 25 into perimeter frame 27. The end of lifting rod 58 is threaded and provided with a tapered washer and nut which abuts the upper leg of perimeter frame 27. A $\frac{1}{2}''\times 178$ "12 gage unitstrut, which is a rectangular steel extrusion 62, is welded to pan 25 along its perimeter to prevent, inter alia, crushing of pan 25 when module 20 is lifted on rod 58.

Rod 58 may be encased within a 1" diameter conduit which serves as a sleeve to guide rod 58 when inserted through the sidewall of module 12. Thus 1" bore 50 is continued through flooring 24, pan 25, unitstrut 62 and upper flange 64 of perimeter frame 27.

To further provide reinforcement a $2''\times\frac{1}{2}$ plate 67 is welded between upper flange 64 and lower flange 66 of perimeter frame 27 at a position approximately 3" longitudinally displaced away from the extension of bore 50 in upper flange 64. Thus, as devised and described in FIGS. 4–6, modules 12 can be securely and easily lifted into place, lifting rods 58 then unbolted from module 12 and threaded into a conduit included within the walls and structure of the mixed module 12 followed by the lifting of the mixed module and so forth. Thus, a single set of lifting rods 58 is employed at the assembly site utilizing each of the modules without necessity for any modification of harness 42 from one module to the next or other special on-site fabrication of the lifting elements.

Figure 8:
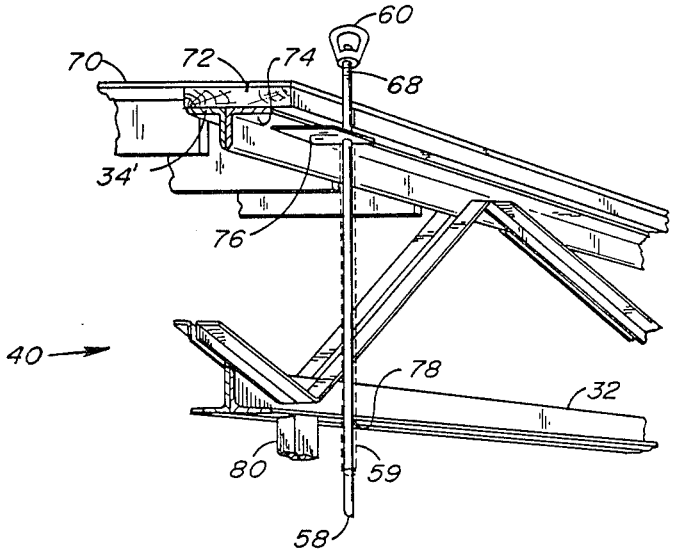
FIG. 8 is a perspective view of a portion of the lifting element as seen in a roof truss of the upper floor modules.

The lifting element incorporated within the upper story module 13 is identical to that described in connection with FIGS. 3–7 with the exception, of course, of the disposition of lifting rod 58 through the roof truss. Turn now to FIG. 8 which is a perspective view of lifting rod 58 disposed through a 1" conduit 59 in truss 40 of the upper floor modules 13. As before, a 1" bore is defined through the lifting structure, as plywood roof sheeting 70, board 72 and through upper flange 74 of upper rafters 34 in a manner similar to that described in connection with FIGS. 4–6. A reinforcing plate 76 as before is welded to the underside of flange 74 of rafter 34 and the lifting rod hole is defined therethrough.

Lifting rod 58 continues as before through truss 40 into a lower hole 78 defined through lower rafter 32′ and a similar reinforcing plate (not shown in FIG. 8) welded to lower rafter 32′. A 54×4 inch wood post may be temporarily wedged between lower rafter 32′ and the opposing floor surface approximately parallel to lifting rod 58 to provide for spacing and rigidity at the lifting point. Wood post 80 is later removed when the building unit is erected.

Return now to the lateral wall bracing as best depicted in FIG. 1. The three stories of stacked modules include diagonal bracing between windows in a hierarchical arrangement between stories. For example, modules 12 which comprise the first floor of structure 10 include diagonal bracing, generally denoted by reference numeral 80, between each window. Modules 12 on the second story, immediately above the first story modules 12 also include diagonal bracing between the windows but to a reduced degree. In the illustrated embodiment, the diagonal bracing in one inter-window space in each module has been deleted from the second floor as compared to the first floor. The first floor may also include an additional one or more bracings at the ends of the window spacing at a position on the wall where no window occurs.

The bracing of the third story is even further reduced as compared to the second story. Again in the illustrated embodiment each upper story module 13 has a single inter-window spacing with bracing. The details of the bracing are shown in enlarged scale in side sectional view in FIG. 9 and in plan view in FIG. 10. The bracing is comprised of two crossed $4''\times 1''$ straps 82 welded to each other at their intersection 84 and to face plates 86 in bottom cords 88 and face plates 90 in top cords 92. Bracing straps 82 may also be welded to any adjacent studs 94.

Figure 9:
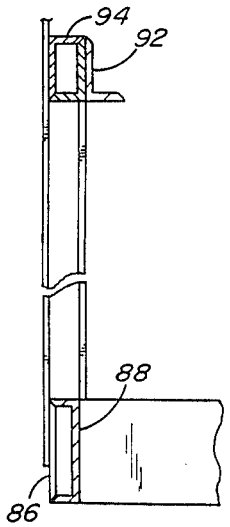
FIG. 9 is a side view in enlarged scale and greater detail of diagonal wall bracing depicted diagrammatically in FIG. 1.
Figure 10:
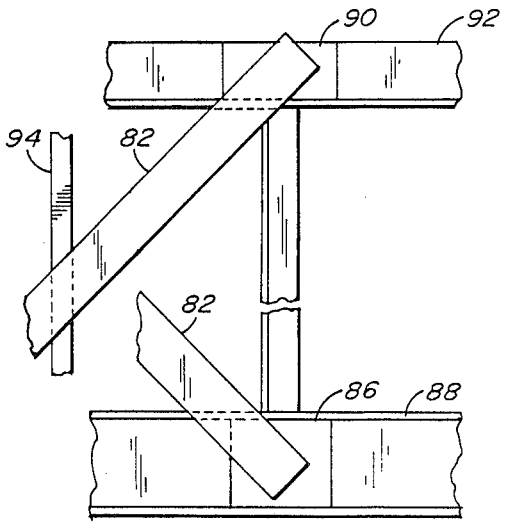
FIG. 10 is a plan view of the wall bracing as shown in FIG. 9.

Upper cord 92 is comprised of two back-to-back angle irons so that facing plate 90 is comprised of an opposing angle iron segment 94 welded to the exterior angle iron as best depicted in the cross-sectional view of FIG. 9. Bottom cord 88 on the other hand is a C-beam so that facing plate 86 is typically an 8" square plate.

By this means reinforcement may be integrated into the side walls of the structure and identically mirrored on opposing sides. The exact manner of wall bracing spacings and their reduction from one story to the next story may be altered according to the number of stories includes within structure 10.

Many modifications and alterations may be made by those having ordinary skill in the art without departing from the spirit and scope of the invention. Therefore, the illustrated embodiment should be understood as being set only by way of example and should not be construed as limiting the invention as defined by the following claims.

I claim:

1. An improvement in prefabricated multi-story structures assembled with the use of a single reusable harness comprising:

a plurality of rigid, preassembled metallic modular units forming a three dimensional structure, each unit comprising in turn a perimeter frame with a plurality of sides, a corresponding plurality of side walls rigidly connected to each said side of said perimeter frame, a ceiling truss structure connected to said side walls, said plurality of modular units adapted for arrangement into an array of such modular units to comprise said multi-story structure; and means for providing attachment for lifting said module, said means arranged and configured to accept said harness, said means comprising a plurality of lifting elements integrated into said modular unit, each lifting element comprising:

a lifting rod;

means for securing said lifting rod to said ceiling truss structure, said lifting rod being disposed through said side walls; and means for connecting said lifting rod to said perimeter frame, whereby said plurality of modular units may each be lifted and assembled in a horizontal and vertical stacked array to form said multi-story structure, without distortion of said modular unit when lifted.

2. The improvement of claim 1 wherein said ceiling truss structure comprises an upper rafter and a lower rafter, said means for securing said lifting rod to said ceiling truss structure comprising a bore defined through said upper rafter and a bore aligned therewith defined through said lower rafter, said upper and lower rafters including reinforcing plates fixed thereto in the position of said bores, reinforcing means for connecting said upper and lower rafters together within said ceiling truss structure.

3. The improvement of claim 2 wherein said reinforcing means for connecting said upper and lower rafters within said truss structure comprises diagonal bracing connected at opposing ends to said upper and lower rafters.

4. The improvement of claim 3 wherein said reinforcing means for connecting said upper and lower rafters further comprises a vertical truss connected at one end to said upper rafter and connected at said other end to said lower rafter.

5. The improvement of claim 4 wherein said vertical truss is comprised of four spaced-apart vertical elements generally parallel to said lifting rod and connected at its ends to said upper and lower rafters proximate to said bore defined through said rafters for said lifting rod.

6. The improvement of claim 1 wherein said means for connecting said lifting rod to said perimeter frame comprises a temporarily fixable connection to said perimeter frame and means for stiffening said perimeter frame in the proximity of said temporarily fixable connection.

7. The improvement of claim 6 wherein said temporarily fixable connection is a threaded bolt connection defined on the lower end of said lifting rod and a bore defined through said perimeter frame, said lifting rod disposed through said bore and temporarily fixed through said perimeter frame by attachment of a bolt onto said threaded end of said lifting rod, said means for stiffening said perimeter frame comprising a vertical stiffening plate affixed to said perimeter frame in said proximity of said bore.

8. The improvement of claim 1 wherein said array of modular units includes a vertical disposition, and further comprising means for stiffening said side walls of each of said plurality of modular units, the degree of stiffening incorporated within said side wall of each modular unit being reduced the higher the vertical position of the modular unit within said array.

9. The improvement of claim 8 wherein said means for stiffening comprises a plurality of interconnected diagonally disposed straps integrally affixed within said side walls, the number of diagonal straps within each module being varied depending upon the degree of stiffness desired within said side walls.

10. The improvement of claim 9 wherein said side walls include a plurality of window frames defined therethrough, said pair of diagonal straps being integrated into said side walls between said window frames.

11. The improvement of claim 1 wherein said array of modular units includes a vertical disposition, and further comprising means for stiffening said side walls of each of said plurality of modular units, the degree of stiffening incorporated within said side wall of each modular unit being reduced the higher the vertical position of the modular unit within said array, wherein said means for connecting said lifting rod to said perimeter frame comprises a temporarily fixable connection to said perimeter frame and means for stiffening said perimeter frame in the proximity of said temporarily fixable connection.

12. An improvement in prefabricated multi-story structures assembled by use of a universal harness comprising:

a plurality of metallic modular units, each unit comprising in turn a perimeter frame with a plurality of sides, a corresponding plurality of side walls rigidly connected to each said side of said perimeter frame, and a ceiling truss structure connected to said side walls; and means for providing attachment for lifting said module, said means arranged and configured to accept said harness, where said means for providing a lifting attachment to each modular unit comprises a plurality of lifting elements integrated into said modular units, each lifting element comprising:

a lifting rod;

means for securing said lifting rod to said ceiling truss structure, said lifting rod being disposed through said side walls;

means for connecting said lifting rod to said perimeter frames;

means for stiffening said side walls of each of said plurality of modular units, the degree of stiffening incorporated within said side wall of each modular unit being reduced as the vertical position of the modular unit within said array moves upwardly, whereby said plurality of modular units may each be lifted and assembled in a horizontal and vertical stacked array to form said multi-story structure.

13. The improvement of claim 12 wherein said ceiling truss structure comprises an upper rafter and a lower rafter, said means for securing said lifting rod to said ceiling truss structure comprising a bore defined through said upper rafter and a bore aligned therewith defined through said lower rafter, said upper and lower rafters including reinforcing plates fixed thereto in the position of said bores, and reinforcing means for connecting said upper and lower rafters together within said ceiling truss structure, wherein said means for connecting said upper and lower rafters within said truss structure comprises diagonal bracing connected at opposing ends to said upper and lower rafters, wherein said means for connecting said upper and lower rafters further comprises a vertical truss connected at one end to said upper rafter and connected at said other end to said lower rafter, and wherein said vertical truss is comprised of four spaced-apart vertical elements generally parallel to said lifting rod and connected at its ends to said upper and lower rafters proximate to said bore defined through said rafters for said lifting rod.

14. The improvement of claim 13 wherein said means for connecting said lifting rod to said perimeter frame comprises a temporarily fixable connection to said perimeter frame and means for stiffening said perimeter frame in the proximity of said temporarily fixable connection.

15. The improvement of claim 14 further comprising means for stiffening said side walls of each of said plurality of modular units, the degree of stiffening incorporated within said side wall of each modular unit being reduced as the vertical position of the modular unit within said array moves upwardly, and wherein said means for stiffening comprises a plurality of interconnected diagonally disposed straps integrally affixed within said side walls, the number of diagonal straps within each module being varied depending upon the degree of stiffness desired within said side wall of said modular unit, the stiffness of said sidewalls of each modular unit increasing with an increasing number of said strap pairs integrated within said side walls.

16. The improvement of claim 15 wherein said side walls include a plurality of window frames defined therethrough, said pair of diagonal straps being integrated into said side wall between said window frames.

17. An improvement in prefabricated multi-story structures comprising:

a uniform harness, including at least four lifting rods;

a plurality of rigid, fully preassembled metallic modular units, each unit comprising in turn a perimeter frame with a plurality of sides, a corresponding plurality of side walls rigidly connected to each said side of said perimeter frame, and a ceiling truss structure connected to said side walls said plurality of units stackable to form an array of said units;

means for providing attachment for lifting said module, said means arranged and configured to accept said uniform harness, where said means for providing a lifting attachment to each modular unit comprises a plurality of lifting elements integrated into said modular units, each lifting element comprising:

means for securing one of said lifting rods to said ceiling truss structure, said one lifting rod being disposed through said side walls; and means for connecting said one lifting rod to said perimeter frames, wherein said ceiling truss structure comprises an upper rafter and a lower rafter, wherein said means for securing said one lifting rod to said ceiling truss structure comprises a bore defined through said upper rafter and a bore aligned therewith defined through said lower rafter, said upper and lower rafters including reinforcing plates fixed thereto the position of said bores, and reinforcing means for connecting said upper and lower rafters together within said ceiling truss structure.

wherein said reinforcing means for connecting said upper and lower rafters within said ceiling truss structure diagonal bracing connected at opposing ends to said upper and lower rafters, wherein said reinforcing means for connecting said upper and lower rafters further comprises a vertical truss connected at one end to said upper rafter and connected at said other end to said lower rafter, wherein said vertical truss is comprised of four spaced-apart vertical elements generally parallel to said one lifting rod with each connected at its ends to said upper and lower rafters proximate to said bore defined through said rafters for said one lifting rod, wherein said means for connecting said one lifting rod to said perimeter frame comprises a temporarily fixable connection to said perimeter frame and means for stiffening said perimeter frame in the proximity of said temporarily fixable connection, and wherein said temporarily fixable connection is a threaded bolt connection defined on the lower end of said one lifting rod and a bore defined through said perimeter frame, said one lifting rod disposed through said bore and temporarily fixed through a perimeter frame by attachment of said bolt onto said threaded end of said one lifting rod, said means for stiffening said perimeter frame comprising a vertical stiffening plate affixed to said perimeter frame in said proximity of said bore, whereby said plurality of modular units may each be lifted and assembled in a horizontal and vertical stacked array to form said multi-story structure utilizing a single uniform harness.

18. The improvement of claim 17 further comprising means for stiffening said side walls of each of said plurality of modular units, the degree of stiffening incorporated within said side wall of each modular unit being reduced the higher the vertical position of the modular unit within said array, wherein said means for stiffening comprises a plurality of interconnected diagonally disposed straps integrally affixed within said side walls, the number of diagonal straps within each module being varied depending upon the degree of stiffness desired within said side wall of said modular unit, the stiffness of said sidewalls of each modular unit increasing with an increasing number of said strap pairs integrated within said side walls, and wherein said side walls include a plurality of window frames defined therethrough, said pair of diagonal straps being integrated into said side wall between said window frames.

* * * * *